United States Patent [19]

Kyytsonen et al.

[11] Patent Number: 4,789,109

[45] Date of Patent: Dec. 6, 1988

[54] WEB WINDING METHOD AND WINDER

[75] Inventors: Markku Kyytsönen, Järvenpää ; Raimo Pihlajamaa, Helsinki; Kai Fabritius, Hyvinkää ; Heikki Niskanen; Jaakko Uotinen, both of Järvenpää, all of Finland

[73] Assignee: Oy Wärtsilä Ab, Helsinki, Finland

[21] Appl. No.: 934,552

[22] Filed: Nov. 24, 1986

[30] Foreign Application Priority Data

Nov. 28, 1985 [FI] Finland ..... 854703

[51] Int. Cl.[4] ..... B65H 19/20; B65H 17/12

[52] U.S. Cl. ..... 242/56 R; 242/66

[58] Field of Search ..... 242/56 R, 66

[56] References Cited

U.S. PATENT DOCUMENTS

| | | | |
|---|---|---|---|
| 2,537,588 | 1/1951 | Husson | 242/56 R |
| 3,918,654 | 11/1975 | Okuba et al. | 242/56 R |
| 4,345,722 | 8/1982 | Kuhn | 242/56 R |
| 4,370,193 | 1/1983 | Knauthe | 242/56 RX |
| 4,444,360 | 4/1984 | Kaipf et al. | 242/66 X |
| 4,516,735 | 5/1985 | Snygg | 242/56 R |
| 4,601,441 | 7/1986 | Oinonen et al. | 242/66 X |

*Primary Examiner*—Stuart S. Levy
*Assistant Examiner*—Steven M. DuBois
*Attorney, Agent, or Firm*—Dellett, Smith-Hill and Bedell

[57] ABSTRACT

The invention relates to a web winding method and a winder for carrying out core replacement in a support drum winder. The core replacement is carried out with a sequence of measures, where the cutting of the web, removing of completed rolls (3) and placing of a new roll core between the support drums (1,2) is carried out by one single device comprising cutting, pushing and feeding means. The web (18) is held unmovably towards the trailing support drum (1) during the core replacement by means of a retainer device (16,17). For forwarding the removal of the rolls these are lifted by the same retainer device, if needed, to a height as required by the pusher device.

21 Claims, 7 Drawing Sheets

WEB WINDING METHOD AND WINDER

Figure 1:
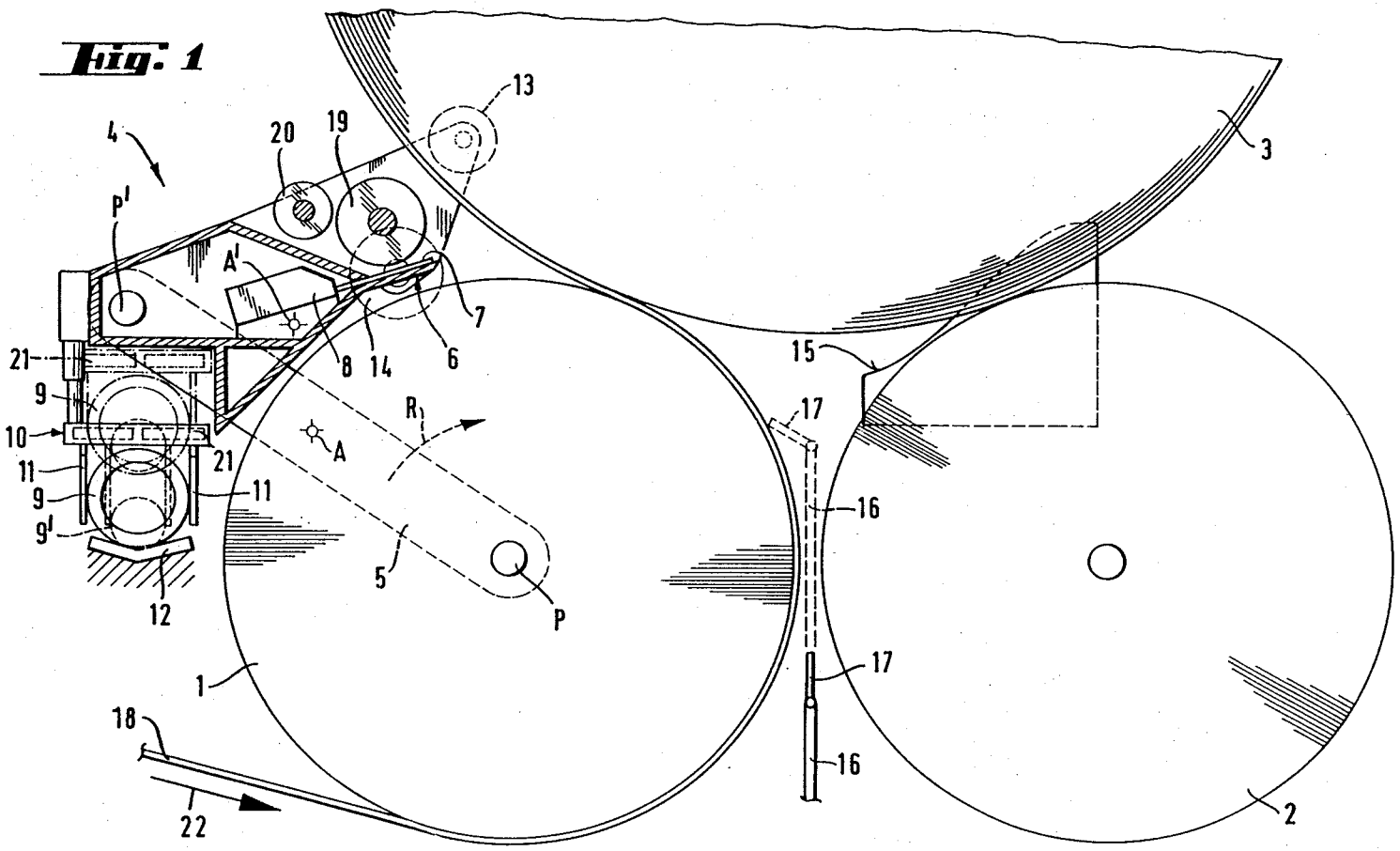

The invention relates to a web winding method and a winder to applying the method for winding a web in a support drum winder, which includes a trailing and a leading support drum, web cutting means, pushing means for moving a completed roll from the support drums, and feeding means for a new roll core.

In the description below and in the attached claims the notion trailing support drum indicates that suport drum with which the roll core forms the first drum nip in the running direction of the web. The notion customer roll indicates a completed roll to be removed, or a roll which as undersized is to be removed for instance due to a broken web. The notion core replacement refers to the whole sequence of measures, with which the customer roll is removed and a new core is positioned in its operating location in the gap formed by the support drums. The winding operations includes in addition to the actual winding also the core replacement operation.

The operation speed of modern web winders is very high, in some devices the running speed of the web can even reach up to 2600 m/min. Hereby the idle time spent due to core replacement can be quite a noticeable factor in affecting the efficiency of the winder, and this time should thus be minimized. For this purpose a number of different solutions have been developed, which under semi-automatic control carry out all the principal operations of core replacement, i.e. cutting the web, removal of the customer roll and positioning of a new core in the gap between the drums. The development has advanced farthest e.g. in devices according to the patent publication U.S. Pat. No. 4,601,441, in which most of the principal operations described above have been functionally united within the same core replacement device. A drawback has then been i.a. provision of functionally secure cutting of the web. Also controlling the end of the web after the cutting has required using separate, and often complicated and space requiring operation devices. According to the solution disclosed in the patent application U.S. Pat. No. 4,368,855, the cutting of the web is carried out by means of a cutting device separate from the roll pusher device and brought to its operating position by lifting the cutting blade up from between the support drums for the time of core replacement. A drawback in this solution is i.a. a relatively long time required for the core replacement and the difficulty of effectively synchronizing the separate operations. In addition the control of the end of the web after cutting is not very satisfactory in this device. In case the end of the web slips down from between the support drums, this causes costly interruptions in the winding process.

In addition to what has been described above, the known technique applies poorly to removing customer rolls with a small diameter. If the web is broken part way through the winding operation using known devices, in most cases manual work by the process controllers is needed for removing this roll, because the operation of known pusher devices has primarily been designed for removing fully completed customer rolls. This kind of interruption time is very costly from the viewpoint of the efficiency of the winding process.

The object of the invention is to create a web winding method and a winder, which eliminate the problems mentioned above in an uncomplicated way and which ensure secure and favourable operation for the device in an economical way.

The invention is characterized in that core replacement is carried out with sequence of measures in which new winding is started during the previous winding, so that the cutting of the web is carried out during the pushing operation by means of cutting and feeding means connected to the pushing device, and that the web is held unmovably towards the trailing support drum during the core replacement by means of a retainer device, that also facilitates removal of customer rolls from the winder independent of their diameter by lifting them to a height as required by the pushing means. For supporting and holding the web during core replacement the retainer device is to be fed out from between the support drums in order to retain the web against the trailing support drum. The cutting means comprises devices for cutting the web through a stroke-like movement of a cutter blade, which movement is directed to the tip region of the retainer device, towards the part of the web kept strained by it. By this means a quite secure cutting operation is accomplished, at the same time as quite a reliable control for the end of the web is achieved. A further advantage of this solution is also the feature, that the operation can be speeded up in comparison with the current methods, for after cutting of the web the customer roll can be handled quicker and with less care, because one need not take care of uncontrolled break of web.

According to a favourable embodiment the retainer device includes two parts so that a head portion is articulatedly connected to an arm portion and turnable so as to hold the web firmly towards the mantle of the trailing support drum during core replacement. In this way the lifting-out of the retainer device does not require any special arrangements as to the distance between the support drums, and the region in which the web is pressed towards the trailing support drum can be arranged at a suitable height. For securing the holding operation the head portion of the retainer is favourably formed blunt. For moving the retainer and its head portion known operation devices are used, which are not as such included within the scope of the invention.

The retainer device is fed into its operation position between the support drums directly upwards from the rest position located below and between the drums. This solution is constructionally uncomplicated. An alternative solution, favourable in view of space requirements, is to feed the retainer out by means of a turning movement, so that the arm member of the device is either directly or indirectly journalled at a location that is in the region of the axis of the leading support drum.

For forwarding the removal of very small customer rolls it is favourable to arrange the operation of the retainer so, that if required it may lift said rolls up from the gap formed by the support drums into such a position, from which the pushing means is able to push the rolls further over the leading support drum. Then the head portion of the retainer is favourably turned towards the trailing support drum, so that the customer roll is supported to the leading support drum in its lifted-up position, or alternatively is totally supported by the retainer.

When the core replacement starts, the rotation of the support drums and the web feeding to the device stop. By cutting the web at an early enough phase of the pushing process, one avoids the need for feeding further web when the core replacement operation proceeds. If necessary additional web is obtained from the customer roll when it rotates drawn by the web and supported by the leading support drum and the pusher rolls. A favourable cutting of the web is forwarded by arranging the cutter blade at the front of the flat or wedge-like pusher device, as well as by accomplishing the cutting with a stroke-like movement of the cutter blade.

In a favourable solution the feeding means for a new core and the web cutter device are connected to the pusher device for obtaining a compact and space saving construction. As an advantage of this kind of an arrangement, there may specially be mentioned the possibility to speed up the core replacement operation and to avoid use of separate constructions. From the viewpoint of removing small customer rolls, the movement of the front of the pushing means should follow the mantle surface of the trailing support drum, without touching it however. It is favourable to arrange this kind of trajectory so that the pushing, cutting and feeding device is with the assistance of its support arm turnably supported to a point at the region of the axis of the trailing support drums.

When the pushing of the customer roll proceeds, said support arrangement would however have as a result that the front of the pushing means would hit against the leading support drum before having been able to move the customer roll over the leading support drum. Due to this the device is to be turnably supported to its support arm so that the front of the device can be lifted when the pushing operation proceeds. Said lifting is favourably accomplished so that one or several support cylinders are arranged at the side of the pusher device and supported to a continuous upward leading slide surface or groove at the side of the winder. Also the movement of the device along the mantle surface of the trailing support drum can be guided by a corresponding support cylinder - slide surface - system. Alternatively, at the initial phase of the pushing operation the turning of the device with regard to the support arm can be controlled by means of fixed support positions between the device and the support arm, i.e. known mechanical means that locks the mutual position. By this kind of support positions also the return movement of the pusher device can be simplified so, that during the return movement turning of the pusher device with regard to its support arm is prevented. By arranging the support for the pusher device in said way, the desired trajectory for the device can be accomplished by means of only one operating device acting on the support arm of the pusher device.

The pushing means includes favourably one or several rotatable or rotating pusher rolls or the like located in front of and/or above it, and through which pushing force is transmitted from the pushing means to the customer roll to be moved. By this means friction can be decreased and moving of the customer roll can be secured without making damage to the vulnerable mantle of the roll.

A new core is brought to its rolling position in the gap formed by the support drums by the feeding means. The feeding means comprises favourably holding grips provided with releaseable locking facility. The holding grips are favourably movable in the vertical direction so, that they can pick up new cores arranged on a core shelf during the time when the pushing device is in the rest position behind the winder during the winding operation. Through vertical movement new cores can also be lowered in the gap between the support drums. The dropping distance is then favourably smaller than the diameter of the cores, by which means the cores are prevented from taking a crosswise position in the gap. The trajectory for the pusher device is then dimensioned so, than when the pusher device reaches its end position the feeder device and its holding grips are positioned right above the gap of the support drums.

Alternatively the feeding system for new cores can be arranged within the scope of the invention such that the winder includes a separate feeder member articulatedly supported to the support arms of the pushing device and placing the cores arranged thereto into the winding position between the support drums. When the pusher device turns in the described way with regard to its support arm at the end phase of its trajectory, the operation of said feeder member can easily be arranged in an uncomplicated and economical way.

The cutter blade is favourably serrated. When a serrated blade with teeth of different lengths is used, the force required for cutting the web is minimized.

Figure 3:
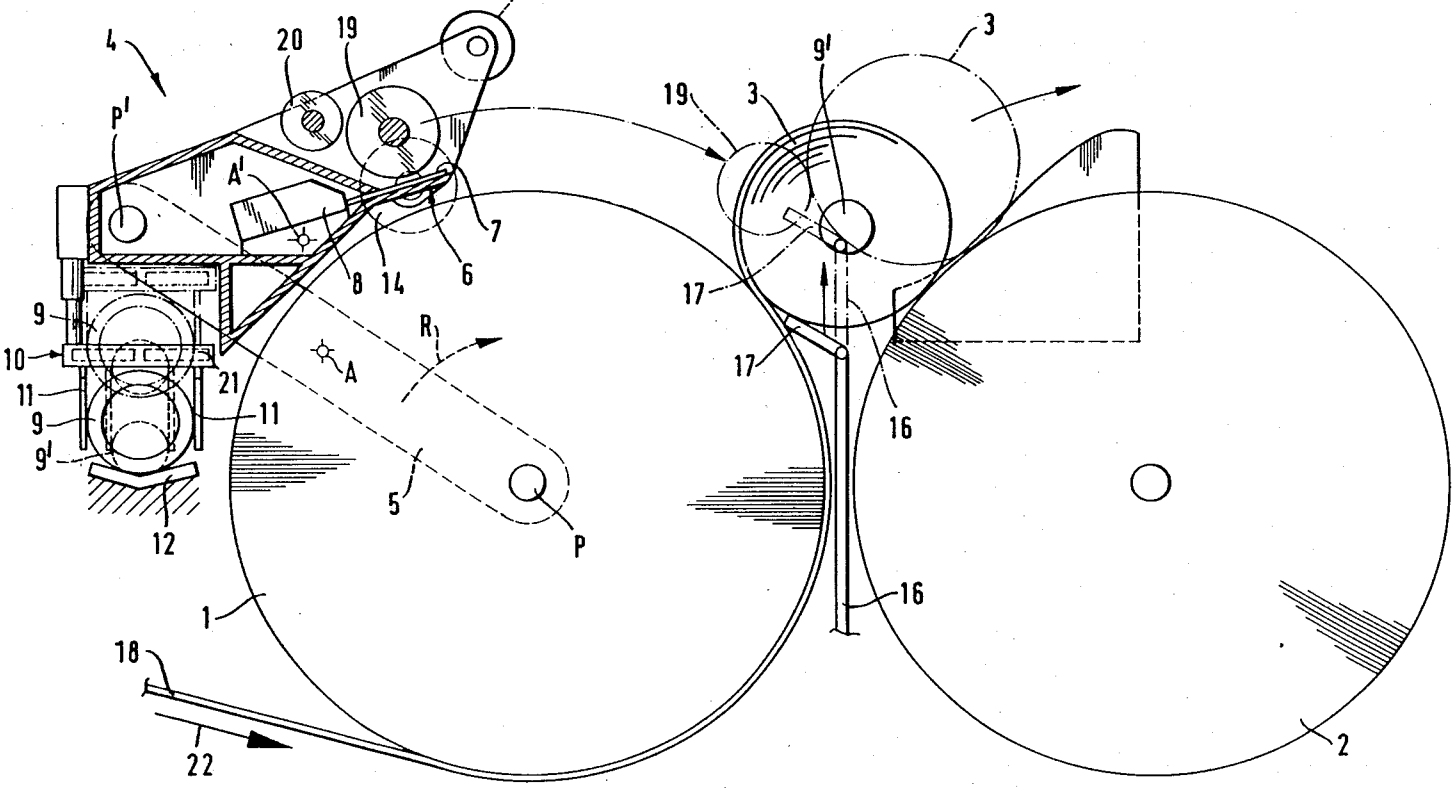
Figure 4:
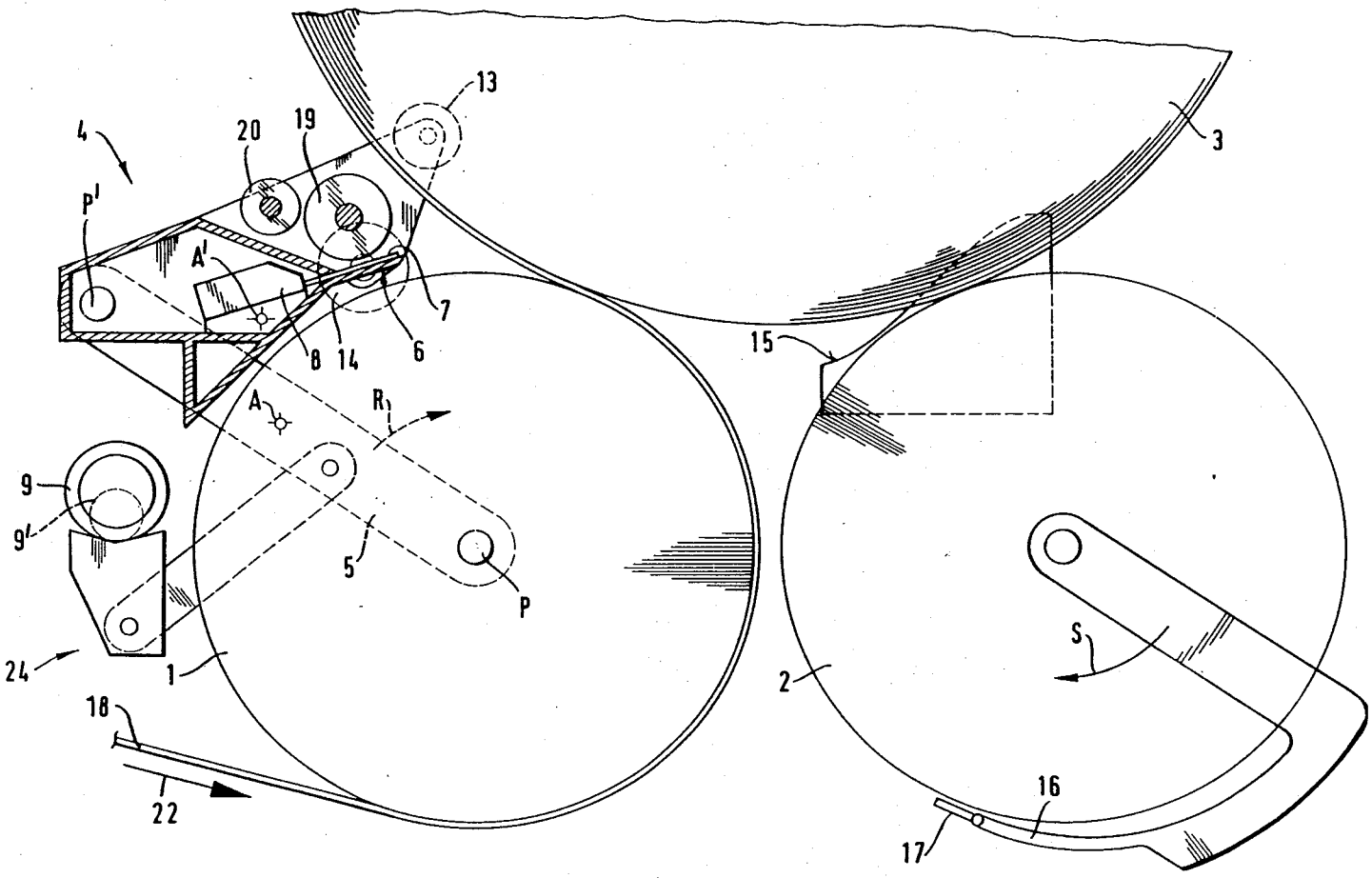
Figure 5:
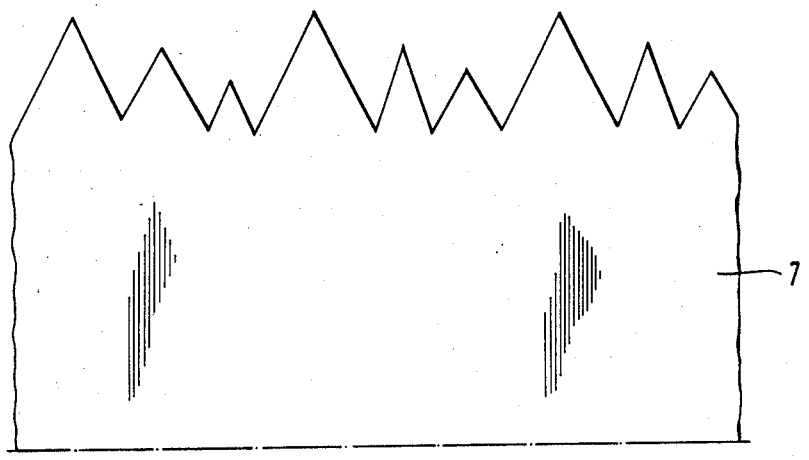

In the following the invention is described more in detail with reference to the accompanying drawing, in which FIG. 1 shows a support drum winder according to the invention as a side view at the end phase of the winding operation with the pushing feeding device in a rest position;

FIGS. *2a*, *2b*, and *2c* show a winder according to FIG. 1 when the pushing operation proceeds, FIG. 3 shows a winder according to FIG. 1 relating to an embodiment, in which a retainer device lifts a small customer roll for forwarding removal thereof, FIG. 4 shows another embodiment for the pusher device and the retainer device according to the invention, FIG. 5 shows a design for a cutter blade according to the invention.

The reference 1 in the drawing refers to a trailing support drum of a support drum winder and reference 2 to a leading support drum. Reference 3 designates a customer roll. A pusher device 4 being in a rest position in FIG. 1 is via support arms 5 attached to the winder at a position P, mainly co-axially with the trailing support drum 1. The pusher device 4 is attached at a position P' at the other end of the support arm 5 so, that rotation of the pusher device 4 relative to point P' is allowed within desired limits. The pusher device 4 includes web cutting means 6, which means comprises a cutter blade 7 and a power device 8 of the cutter blade, for instance a compressed air box. The pusher device comprises further feeding means 10 for new roll cores 9 or 9', which comprises core holding grips 11, which are closed around the core and are opened, correspondingly, from around the core symmetrically relative to the core. In the following, reference numeral 9 refers equally to alternatively usable roll cores 9' with smaller diameter. The holding grips 11 move at the extreme positions of the pusher device also in the vertical direction so, that they can fetch cores loaded on a core shelf 12 and lower them again in a gap between the support drums. Reference 21 refers to a support and transfer device for the holder grips 11, which is arranged as known per se. The pusher device comprises also pusher rolls 19 and 20. Located between the support arms 5 and the pusher device there are additionally support positions A and A' by means of which the rotation of the pusher device 4 around the point P' can be mechanically governed and locked if necessary. The pusher device 4 includes, at the tip thereof, support cylinders 13 and 14, which through their backing-up against a support surface or groove 15 effect the rotation of the pusher device 4 around point P', along with the motion of the support arm 5 in a direction R. A retainer device 16, 17 positioned below the support drums 1 and 2, between them, is movable from a gap between the support drums 1 and 2 into a space between support drums and the customer roll 3. A head portion 17 of the retainer is by articulated joint attached to arm portion 16, and thus the head portion can be turned to press against the mantle of support drum 1. The head portion 17 of the retainer is blunt at its tip, in order not to damage the web 18 located between the head portion 17 of the retainer and support drum 1.

Figure 2A:
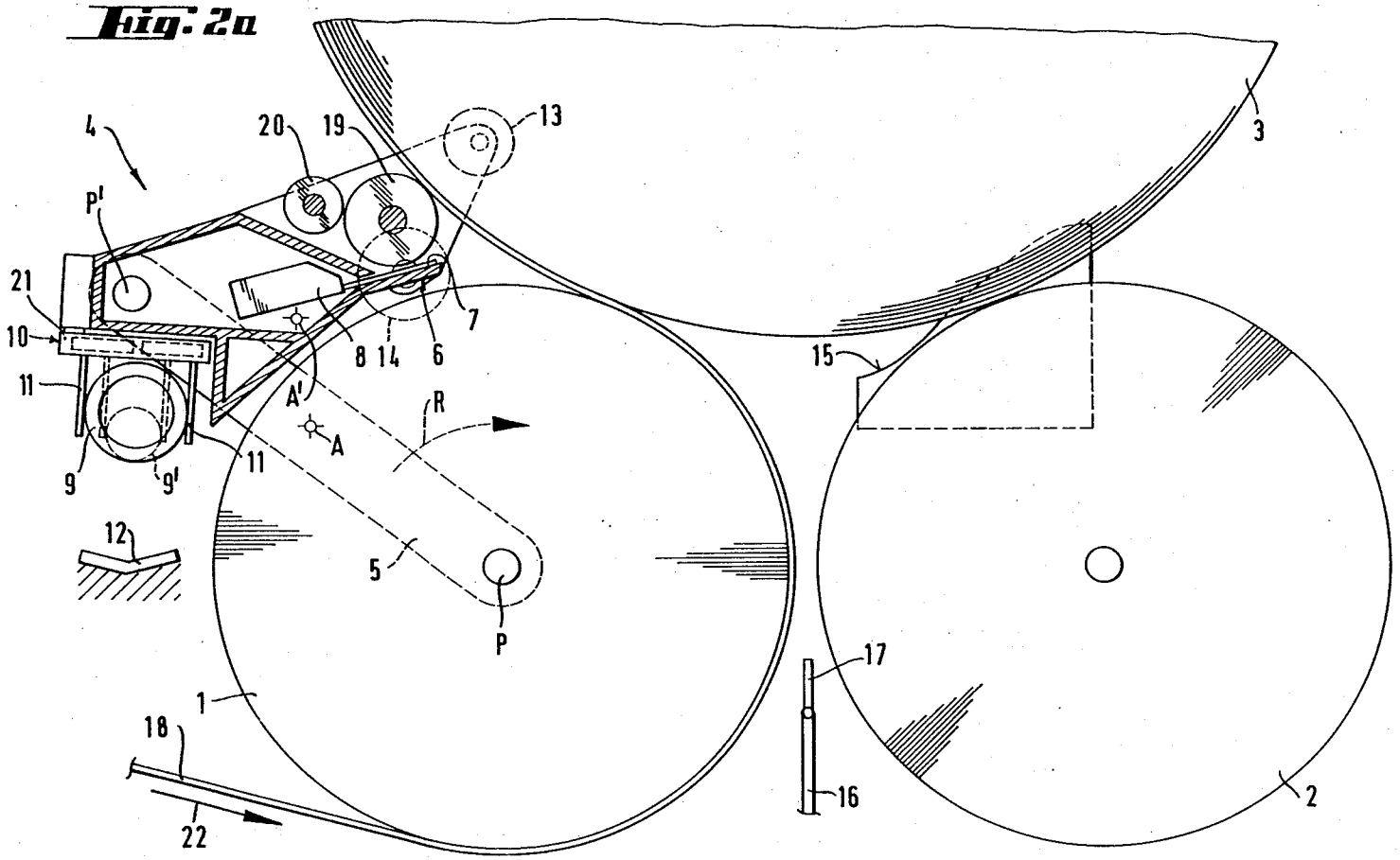

The support drum winder according to the invention operates as follows. The situation just before the removal of a customer roll 3 is as shown in FIG. 2*a*. Holding grip 11 of the core is lowered at its open position around the core 9 fed into the core shelf 12, after which the holding grip 11 is closed to grip the core 9 from the sides hard enough, so that the core is lifted along with the holding grip 11 into a core delivery position. A number of cores placed axially end to end often form together the nucleus of the customer roll. The supply of all cores must hereby be carried out concurrently.

During the initiation of the core replacement function, the web supply into the winder and the motion of the support drums 1 and 2 are stopped. A torque acting aorund point P is generated at the arms 5 by means of a power device, not disclosed, whereby the pusher roll 19, which is attached to the upper and front portion of the pusher device 4, starts to push the customer roll 3 over the leading support drum 2. Depending on the diameter of the customer roll 3 and the diameters of the support drums 1 and 2, some web may be loosened from the customer roll 3, which being supported on the support drum 2 and the pusher roll 19 can rotate counterclockwise in FIG. 1 or 2. In order to maintain the web tensioned, it is favourable to arrange a suitable retarding moment in connection with the freely rotatable support of the trailing drum 1. An essential feature is that there is no need to supply further web 18 from the direction 22 during the core replacement operation.

Before the start of the removal of the customer roll 3, the retainer 16, 17 is raised into its upper position into the space between the support drums 1 and 2 and the customer roll 3, and the head portion 17 is supported at the support drum 1.

When the pushing of the customer roll 3 proceeds the responsibility for pushing may be transferred from the pusher roll 19 to the pusher roll 20, depending on the size of the roll 3.

Figure 2B:
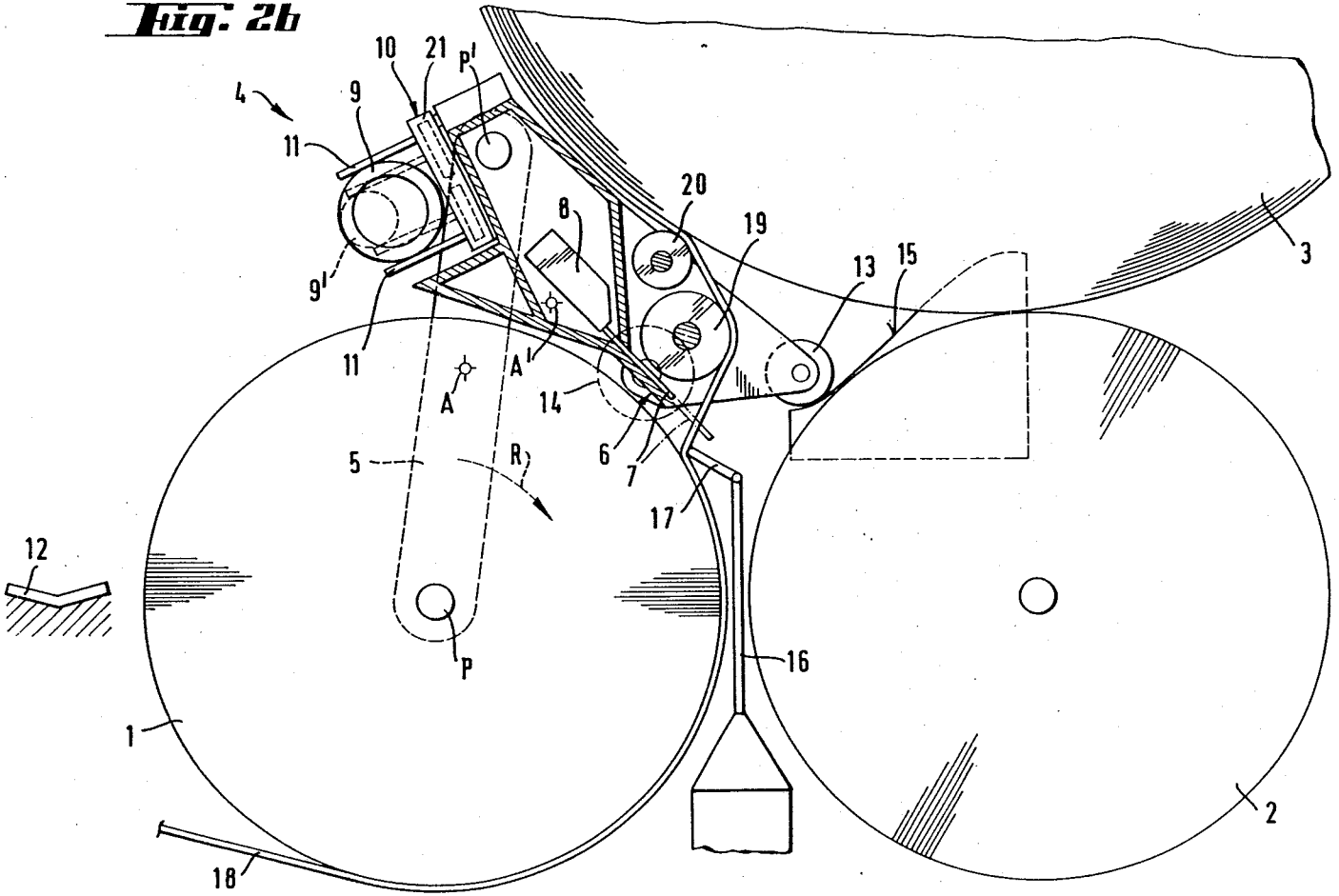

The pushing having proceeded to the position of the pusher device 4 according to FIG. 2*b*, the cutting of the web is carried out. In accordance with FIG. 2*b*, the web runs from the head 17 of the retainer to the roll 3 via the pusher rolls 19 and 20. In the most favourable embodiment the blade 7 of the cutter device 6 carries out a sudden fast stroke, hereby cutting the web 18 throughout the entire width simultaneously, the head of the retainer serving as a backup on the opposite side of the material web 18 relative to the blade 7 and the pusher roll 19 serving as a support on the same side of the web 18 as the blade 7 so that the free length of the web 18 between the head portion 17 of the retainer and the pusher roll 19 is favourably as short as possible. The cutting of the web 18 is so sudden an operation, that the removal of the roll 3 can be carried out without an interruption. The blade 7 is immediately returned to a rest position after the stroke. The motion of the blade 7 is accomplished by some suitable known power device, for instance, by a compressed air box 8.

When the pushing movement proceeds further the support cylinders 13 meet the support or guide surface 15 and begin to lift up the front portion of the pusher device 4, before the front portion of the pusher device 4 runs into the head portion 17 of the retainer or into the leading support drum 2. The pusher device turns hereby around point P'. When the pushing movement proceeds further the support cylinders 14 take the responsibility for lifting from the head portion of the pusher device 4 and the pusher roll 19 take again the responsibility for pushing the customer roll 3. At the phase when the web is already cut, it is also possible to arrange the repsonsibility for pushing to the stationary upper portion of the pusher device 4. The end position for the movement of the pusher device 4 is according to FIG. 2*c*. Then the new roll core 9 is exactly at the position between the support drums 1 and 2, above them. The web retainer 16, 17 is lowered so that the head 17 of the retainer still supports and retains the web 18 against the support drum 1, but when the holding grips of the core next powers the core 9 down into the gap between the support drums 1 and 2, the core 9 does not touch the head 17 of the retainer. When several parallel roll cores 9 are simultaneously lowered into the gap between the support drums by using the method and the device according to the invention, one proceeds so that the cores are prevented from turning crosswise (in other words the heads of the cores 9 are prevented from getting one upon the other), for the cores 9 are advantageously brought so near to the end position thereof that the dropping distance from the holding grips 11 into the gap between the support drums 1 and 2 is smaller than the diameter of the cores. The core 9 being already in the working position the front end 18*a* of the web 18 (FIG. 2*c*) is advantageously between the support drum 1 and the core 9. The holding grips 11 are lifted up in the open position and the pusher device 4 is supported and locked between the positions A and A' whereby the pusher device 4 can be returned to the rest position, whereby, consequently, the return movement if not like the pushing movement. By this means it is secured that the core 9 remains in a desired position. This is important especially in case a glue stripe or two sided tape is used in the core. Only when the head of the pusher device 4 has gone past the core 9 during the return movement is the pusher device released from the support between positions A and A'.

Figure 2C:
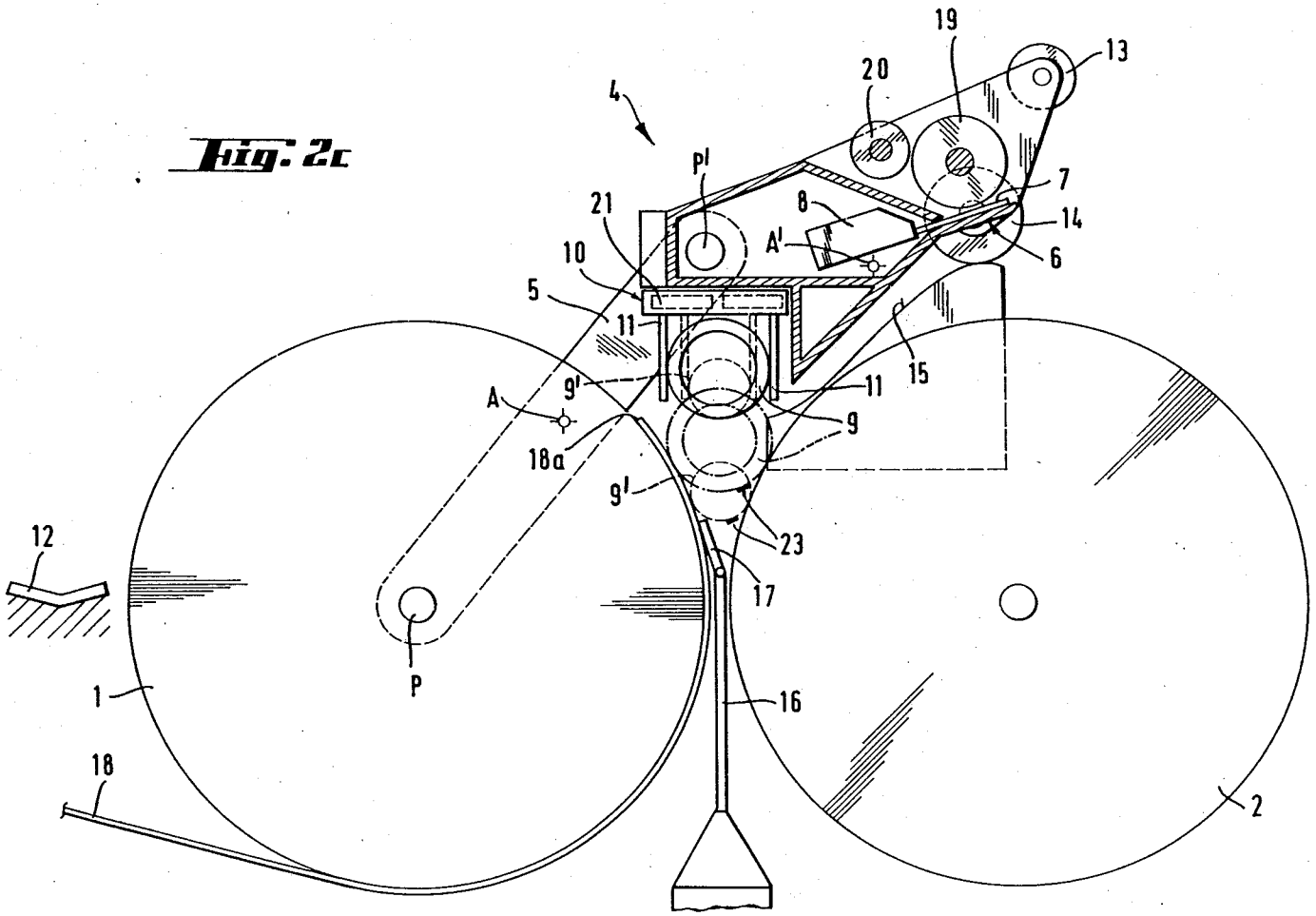

The retainer device 16, 17 is lowered to the lower position and forming of new customer rolls 3 around core 9 can start. A glue stripe or a 2-sided tape can be applied on the core 9 already when they are fed into the core shelf 12, so that when placing the core 9 into the gap between the support drums 1 and 2 the glue stripe or the 2-sided tape is positioned in the region 23 (FIG. 2*c*). Thereby at the beginning of the rolling the glue or the tape adheres to the web 18 and makes the end 18*a* of the web 18 turn around the core.

If the roll 3 is very small, the removal of the roll 3 can be made easier by lifting the roll 3 with the retainer 16,17 in accordance with FIG. 3, whereby the pusher roll 19 is able to push even a roll 3 with a very small diameter perfectly over the support drum 2.

The support arrangement and the trajectory for the retainer device can be arranged according to FIGS. 1–3 or alternatively according to FIG. 4. An advantage with the solution according to the first embodiment is accomplishing an uncomplicated structure, whereas space is saved with the arrangement according to FIG. 4. In addition the latter embodiment is also better adaptable for modernizing rollers already in use. In FIG. 4 the retainer is arranged to move into its working position by means of a movement substantially coaxial with the support drum 2. The movement of the retainer in the direction S is arranged by means of known operating devices, which are not described more in detail.

The core feeder 10 for the cores need not be according to the device of FIGS. 1-3. Essential is that the cores 9 are brought simultaneously with the pushing of the roll 3 or immediately thereafter from the same direction than the pushing movement, and locating of core 9 exactly in the right position into the gap between the support drums 1 and 2. An alternative core feeder is disclosed in FIG. 4. In this embodiment the core feeder includes a separate feeding member 24, which is supported to the support arm 5 by joints and is provided with an operating device. The feeding member 24 lcoates the new cores into the working position between the support drums 1 and 2 after the pusher device 4 has removed the finished customer roll 3 from the gap between the support drums. The feeding member 24 grips the cores for instance by means of a vacuum operated gripping device.

The cutter blade 7 is advantageously serrated and comprises different tooth lengths in accordance with FIG. 5, whereby the force needed for cutting the web is decreased.

The invention is not limited to the embodiments shown, but several embodiments are feasible within the scope of the attached claims.

We claim:

1. A support drum winder, comprising:

a trailing support drum having a central axis of rotation, a leading support drum having a central axis of rotation and disposed substantially parallel to the trailing support drum, whereby the support drums define a web winding position therebetween, support arm means mounted for pivotal movement about an axis which substantially coincides with the central axis of the trailing support drum, core replacement apparatus carried by the support arm means for movement about the periphery of the trailing support drum when the support arm means undergo pivotal movement, said core replacement apparatus comprising pusher means for engaging a roll in a position between the support drums and pushing it over the leading support drum towards a roll receiving position, web cutting means for engaging and cutting the web when the roll has been moved from the winding position, and core supply means for placing a new roll core in the web winding position after the web has been cut, a retainer device, inserter means for inserting the retainer device between the support drums for holding the web in contact with the trailing support drum, and guide means for engaging the core replacement apparatus and defining a path of movement of the core replacement apparatus such as to ensure that the web cutting means do not strike the leading support drum or the retainer device, the guide means being stationary relative to the central axes of the support drums.

2. A winder according to claim 1 wherein the support arm means comprise at least one support arm and the core replacement apparatus is mounted to said one support arm at a single attachment location which is spaced from the axis of pivotal movement of the support arm means by a distance which is greater than the radius of the trailing support drum.

3. A winder according to claim 1, wherein the core replacement apparatus is supported by the support arm means in a manner permitting pivotal movement of the core replacement apparatus relative to the support arm means about an axis which is spaced from the axis of pivotal movement of the support arm means by a distance which is greater than the radius of the trailing support drum.

4. A winder according to claim 3, wherein the support arm means undergo pivotal movement from a rest position to an end position when carrying out a core replacement operation and the core replacement apparatus is such that when the support arm means undergo pivotal movement from the rest position towards the end position, the web cutting means are initially close to the surface of the trailing support drum, and wherein the winder comprises means for engaging the core replacement apparatus and influencing the path of movement of the web cutting means after the web has been cut so that the cutting means are turned away from the leading support drum and do not strike the leading support drum or the retainer device.

5. A winder according to claim 1, wherein the retainer device is operative to maintain a region of the web under tension when the roll is engaged by the pusher means, and the web cutting means comprise a blade and means for causing the blade to execute a cutting stroke directed at said region of the web.

6. A winder according to claim 1, wherein the web cutting means comprise a serrated cutting blade.

7. A winder according to claim 6, wherein the serrated cutting blade has teeth of different length.

8. A winder according to claim 1, wherein the retainer device comprises a shaft portion and a head portion which is articulatedly connected to the shaft portion and is turnable relative to the shaft portion to engage the web at a location at which the web is in contact with the trailing support drum.

9. A winder according to claim 8, wherein the head portion of the retainer device has a tip region for engaging the web and holding it in contact with the trailing support drum, the tip region of the head portion being blunt so as to avoid damaging the web.

10. A winder according to claim 1, wherein the inserter means comprise an operating device for bringing about linear movement of the retainer device between a rest position in which it is below the support drums and an operating position in which it is between the support drums.

11. A winder according to claim 1, wherein the retainer device comprises a head portion for engaging the web at a location at which the web is in contact with the trailing support drum and an arm portion mounted for pivotal movement about an axis which substantially concides with the central axis of the leading support drum, and the inserter means bring about pivotal movement of the retainer device between a rest position in which the head portion is not between the support drums and an operation position in which the head portion is between the support drums.

12. A winder according to claim 1, wherein the pusher means comprise at least one pusher roll for transmitting pushing force to a roll that is to be pushed from a position between the support drums towards the roll receiving position.

13. A winder according to claim 1, wherein the core supply means comprise holding grips for holding a new roll core, the holding grips being releasable for placing the new roll core in the web winding position.

14. A winder according to claim 1, wherein the core supply means are operative to drop a new roll core freely into the web winding position from a height that is at most as great as the diameter of the new roll core.

15. A winder according to claim 1, wherein the core supply means comprise a new core feeding member which is articulatedly connected to the support arm means for placing a new roll core in the web winding position.

16. A winder according to claim 1, wherein the web cutting means comprise a blade and power means for forcibly moving the blade relative to the pusher means for engaging and positively cutting the web.

17. A support drum winder, comprising:

a trailing support drum having a central axis of rotation, a leading support drum having a central axis of rotation and disposed substantially parallel to the trailing support drum, whereby the support drums define a web winding position therebetween, support arm means mounted for pivotal movement about an axis which substantially coincides with the central axis of the trailing support drum, core replacement apparatus carried by the support arm means for movement about the periphery of the trailing support drum when the support arm means undergo pivotal movement, said core replacement apparatus comprising pusher means for engaging a roll in a position in which the roll rests on the support drums and pushing it upwards, into an equilibrium position in which it rests on the leading support drum and further pushing it beyond the equilibrium position towards a roll receiving position, web cutting means for engaging and cutting the web when the roll has been moved from the winding position and before the roll reaches the equilibrium position, and core supply means for placing a new roll core in the web winding position after the web has been cut, a web retainer device, inserter means for inserting the web retainer device between the support drums for holding the web in contact with the trailing support drum, and guide means for engaging the core replacement apparatus and defining a path of movement of the core replacement apparatus such as to ensure that the web cutting means do not strike the leading support drum or the retainer device, the guide means being stationary relative to the central axes of the support drums.

18. A support drum winder, comprising:

a trailing support drum having a central axis of rotation, a leading support drum having a central axis of rotation and disposed substantially parallel to the trailing support drum, whereby the support drums define a web winding position therebetween, support arm means mounted for pivotal movement about an axis which substantially coincides with the central axis of the trailing support drum, core replacement apparatus carried by the support arm means for movement about the periphery of the trailing support drum when the support arm means undergo pivotal movement, the core replacement apparatus being supported by the support arm means in a manner permitting pivotal movement of the core replacement apparatus relative to the support arm means about an axis which is spaced from the axis of pivotal movement of the support arm means by a distance which is greater than the radius of the trailing support drum, the support arm means undergoing pivotal movement from a rest position to an end position when carrying out a core replacement operation, and said core replacement apparatus comprising:

pusher means for engaging a roll in a position between the support drums and pushing it over the leading support drum towards a roll receiving position;

web cutting means for engaging and cutting the web when the roll has been moved from the winding position, the web cutting means being initially close to the surface of the trailing support drum when the support arm means undergo pivotal movement from the rest position towards the end position; and core supply means for placing a new roll core in the web winding position after the web has been cut, a guide member positioned adjacent to support drums, a retainer device, inserter means for inserting the retainer device between the support drums for holding the web in contact with the trailing support drum, and at least one follower member carried by the core replacement apparatus for engaging the guide member during pivotal movement of the support arm means from the rest position towards the end position, thereby bringing about pivotal movement of the core replacement apparatus relative to the support arm means and influencing the path of movement of the web cutting means after the web has been cut so that the cutting means are turned away from the leading support drum and do not strike the leading support drum or the retainer device.

19. A support drum winder, comprising:

a trailing support drum having a central axis of rotation, a leading support drum having a central axis of rotation and disposed substantially parallel to the trailing support drum, whereby the support drums define a web winding position therebetween, support arm means mounted for pivotal movement about an axis which substantially coincides with the central axis of the trailing support drum, core replacement apparatus carried by the support arm means for movement about the periphery of the trailing support drum when the support arm means undergo pivotal movement, said core replacement apparatus comprising pusher means for engaging a roll in a position between the support drums and pushing it over the leading support drum towards a roll receiving position, web cutting means for engaging and cutting the web when the roll has been moved from the winding position, and core supply means for placing a new roll core in the web winding position after the web has been cut, a retainer device, and inserter means for inserting the retainer device between the support drums for holding the web in contact with the trailing support drum, and wherein the inserter means are able to insert the retainer device between the support drums to such an extent as to engage a roll in the web winding position and lift the roll to a position in which the pusher means are able to engage the roll and push it over the leading support drum.

20. A support drum winder, comprising:

a trailing support drum having a central axis of rotation, a leading support drum having a central axis of rotation and disposed substantially parallel to the trailing support drum, whereby the support drums define a web winding position therebetween, support arm means mounted for pivotal movement about an axis which substantially coincides with the central axis of the trailing support drum, core replacement apparatus carried by the support arm means for movement about the periphery of the trailing support drum when the support arm means undergo pivotal movement, the support arm means undergoing pivotal movement from a rest position to an end position when carrying out a core replacement operation, and said core replacement apparatus comprising pusher means for engaging a roll in a position between the support drums and pushing it over the leading support drum towards a roll receiving position, web cutting means for engaging and cutting the web when the roll has been moved from the winding position, and core supply means for placing a new roll core in the web winding position after the web has been cut, said core supply means comprising holding grips for holding a new roll core, the holding grips being releasable for placing the new roll core in the web winding position, and being movable in the vertical direction when the support arm means are in the rest position or in the end position, so that the holding grips are able to pick up a new roll core from a core shelf and lower the new core towards the web winding position, a retainer device, and inserter means for inserting the retainer device between the support drums for holding the web in contact with the trailing support drum.

21. A support drum winder, comprising a trailing support drum having a central axis of rotation, a leading support drum having a central axis of rotation and disposed substantially parallel to the trailing support drum, whereby the support drums define a web winding position therebetween, support arm means mounted for pivotal movement about an axis which substantially coincides with the central axis of the trailing support drum, core replacement apparatus carried by the support arm means for movement about the periphery of the trailing support drum when the support arm means undergo pivotal movement, the support arm means undergoing pivotal movement from a rest position to an end position when carrying out a core replacement operation, said core replacement apparatus comprising:

pusher means for engaging a roll in a position between the support drums and pushing it over the leading support drum towards a roll receiving position, the pusher means being mounted for pivotal movement relative to the support arm means;

support elements locking the pusher means against pivotal movement relative to the support arm means during return pivotal movement of the support arm means from the end position towards the rest position thereof, whereby pivotal movement of the pusher means relative to the support arm means is limited;

web cutting means for engaging and cutting the web when the roll has been moved from the winding position; and core supply means for placing a new roll core in the web winding position after the web has been cut, a retainer device, and inserter means for inserting the retainer device between the support drums for holding the web in contact with the trailing support drum.

* * * * *